US006366218B1

(12) United States Patent
Ruthroff

(10) Patent No.: US 6,366,218 B1
(45) Date of Patent: Apr. 2, 2002

(54) ARTICULATED TRANSFORMER FOR MEASURING TORQUE ON A ROTATING SHAFT

(76) Inventor: Clyde L. Ruthroff, One Brook La., Holmdel, NJ (US) 07733

( * ) Notice: Subject to any disclaimer, the term of this patent is extended or adjusted under 35 U.S.C. 154(b) by 0 days.

(21) Appl. No.: 09/378,929

(22) Filed: Aug. 23, 1999

(51) Int. Cl.[7] ..... G08C 19/06; G08C 19/12
(52) U.S. Cl. ..... 340/870.31
(58) Field of Search ..... 340/870.31, 870.32, 340/870.35

(56) References Cited

U.S. PATENT DOCUMENTS 3,657,717 A * 4/1972 Glantschnig et al. .. 340/870.31
4,242,666 A * 12/1980 Reschovsky et al. .. 340/870.28
4,312,001 A * 1/1982 Marzolf ..... 340/870.32
4,654,573 A * 3/1987 Rough et al. ..... 320/2
5,142,280 A * 8/1992 Lehle ..... 340/870.31
5,353,020 A * 10/1994 Schurmann ..... 340/870.31
5,736,938 A * 4/1998 Ruthroff ..... 340/870.01
5,801,644 A * 9/1998 Ruthroff ..... 340/870.31

* cited by examiner

*Primary Examiner*—Timothy Edwards
(74) *Attorney, Agent, or Firm*—Charles I. Brodsky

(57) ABSTRACT

The use of an articulated transformer whose windings do not completely encircle the shaft, and with a small gap in-between being provided so that the mounting structure can be opened and the windings slipped over the shaft before being closed once again to form a tuned transformer resonating at the frequency of an electrical power oscillator connected to transmit electrical power from a first location towards a second location.

6 Claims, 4 Drawing Sheets

ARTICULATED TRANSFORMER FOR MEASURING TORQUE ON A ROTATING SHAFT

FIELD OF THE INVENTION

This invention relates to the measurement of horsepower transmitted by the drive shaft of a motor vehicle and, more particularly, to a variant for measuring torque as described in my U.S. Pat. No. 5,801,644.

BACKGROUND OF THE INVENTION

As is set forth in my aforesaid patent, the torque on the drive shaft of an automotive vehicle can be determined through the measurement of the resistance of an included strain gauge, yet without the need for a power supply—such as a battery, on the rotating shaft itself. More specifically, the apparatus of that invention described the transmitting of electrical power from a first place A to a second place B in the direction A to B, for the purpose of powering electrical and/or mechanical equipment used in the measurement of, or operation of, equipment mounted at the second place B. Information obtained through the apparatus of that invention was then generated and transmitted back in the direction B to A, without any mechanical connection whatsoever—while, at the same time, allowing a relative movement of A and B in various coordinates. With the invention set forth, mechanical and electrical functions were then allowed to be performed on B, with information to be obtained on B, then being transmitted back to A, without any source of power on B.

In a preferred embodiment of the invention there described, a first means was included for transmitting electrical power from a first location towards a second location; second means was located at the second location, responsive to the electrical power received from the first means, for the purpose of operating a utilization apparatus; third means was then coupled to the utilization apparatus for generating a signal indicative of its performance, and for transmitting that signal back to the first means via the second means. To carry that out, the first means was stationary in operation, while the second means was mechanically rotational in operation, as where the first means included a fixed electrical coil while the second means included a rotating electrical coil—and in the automobile, truck and motor vehicle environment then in question for measuring horsepower, the second means included an electrical coil on a rotating mechanical shaft.

In the preferred embodiment of the invention there described, the first means further included an electrical power oscillator of given frequency, with the fixed electrical coil and the rotating electrical coil both being tuned to resonate at the frequency of the oscillator. In particular, the fixed electrical coil and the rotating electrical coil were magnetically coupled to constitute a critically coupled transformer tuned to the frequency of the electrical power oscillator. With very small coupling coefficients between the coils of the critically-coupled transformer, an almost 100% efficiency of operation was attained, with the result being that a substantial change in primary current (reflecting the signalling), made possible a remote locating of the fixed apparatus—all possible with a single pair of wires for the connection to the transformer.

Where a strain gauge was mounted on the rotating mechanical shaft, and where the third means generated a signal indicative of the strain gauge at any given instant of time, a digital signal was generated indicative of the resistance of the strain gauge, as utilized in determining the horsepower delivered to the wheels of the vehicle. As there described, such operation was accomplished with the second means being devoid of any source of operating power, and with an absence of mechanical interconnection between the first means and the second means.

Simply stated, in my previous, U.S. Pat. No. 5,801,644 patent, the transmission of both power to the rotating part, and the torque information from the rotating part, was accomplished by means of a tuned transformer consisting of two circular windings around the shaft, coaxial with one another, and closely spaced with no mechanical contact. One winding rotated with the shaft, while the other winding was non-rotating, and was connected by a cable to the fixed part of the vehicle. In accomplishing this so that the torque on the drive shaft (or axle) of an automobile could be measured, the non-rotating winding was held in proper relationship with the rotating winding, and by an arrangement which included a ball bearing mounted on the shaft.

SUMMARY OF THE INVENTION

This invention represents a variation in the apparatus described in such patent, so as to simplify the manner by which the apparatus of this earlier invention could be used. As will be appreciated by those skilled in the art, winding the transformers, making the necessary connections to other circuitry, and installing a bearing could be somewhat impractical to do while the shaft is in its normal position on the car. Experience has shown, in fact, that it is a simpler procedure if the shaft were first removed from the vehicle and disassembled, before the transformer windings on the shaft and the bearing were installed. Such removal operation, and later remounting of the shaft, results, however, in an expense of installation to the torque measuring apparatus, which it would be desirable to avoid. As will be understood, this led to the development of the articulated transformer of the present invention—the importance of which allows the installation to be accomplished in just a few hours, at a "speed shop", in much the same way as if a servicing were done in an automotive repair shop. With the invention at hand, the result follows that one need not have to take off the wheel or the boots, to take the axle completely apart, let alone having to purchase a bearing for the installation, which typically costs some $50.00 and more.

As will be seen from the description that follows, the present invention employs an articulated transformer for the coupling, which does not require access to the ends of the drive shaft (or axle) for installation—and can be installed with the shaft in its normal position on the automobile, whether the ends of the shaft are accessible or not. In the preferred embodiments described, the windings of the transformer do not completely encircle the shaft, but leave a small gap so that the mounting structure can be opened, and the winding slipped over the shaft, before being closed again to form the complete transformer. Although the net inductance is reduced, the proximity of the coils is retained sufficiently close to obtain a high coupling coefficient, with the spacing being only so much as to allow the transformer to slip around the axle. In fact, with an axle of some 1" or so in diameter for a front wheel drive automobile, or for a rear wheel drive automobile with independent suspension, the articulated transformer of the invention will be appreciated to fit right over the axle. Measurements taken, and in accordance with the formulations set forth below, indicate that the magnetic field produced with the gap in the transformer is almost identical to the field that would exist if the gap were not present. At the same time, with this articulated transformer, the need for any bearing to maintain the proper relationship between the windings becomes unnecessary, leading, in part, to the simplification of installation and reduction in expense desired.

BRIEF DESCRIPTION OF THE DRAWINGS

These and other features of the present invention will be more clearly understood from a consideration of the following description, taken in connection with the accompanying drawings, in which.

DETAILED DESCRIPTION OF THE DRAWINGS

Figure 1B:
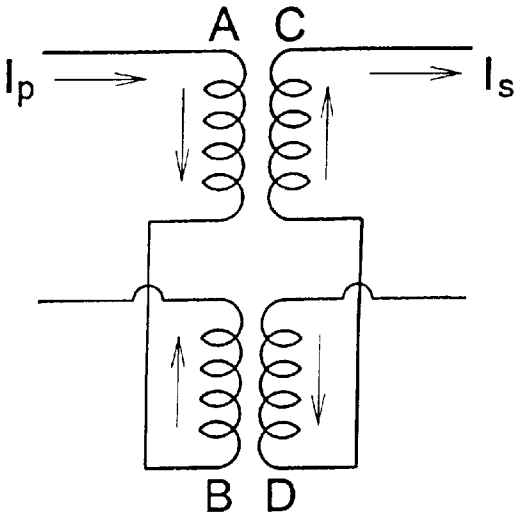
FIG. 1*a* illustrates a first preferred embodiment of an articulated transformer according to the invention, while FIGS. 1*b* and 1*c* respectively show the transformer windings in schematic form and a depiction of the mutual inductance of the transformer half-windings in cross-section.
Figure 1A:
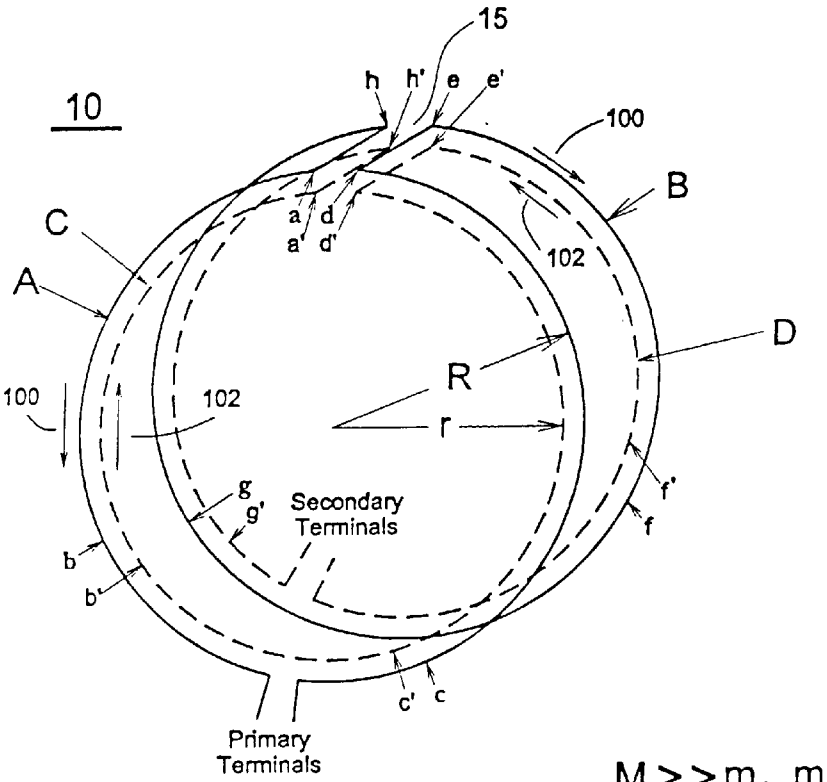

The articulated transformer 10 of FIG. 1*a* includes a primary winding consisting of the two half-windings A and B connected in series, at de and ah. The secondary winding, on the other hand, consists of the two half-windings C and D, connected in series, at d'e' and a'h'. The conductor represented by the solid line abcdefgha constitutes one complete turn of the primary winding of the transformer 10, and consists of the two half-windings A and B—with the half-winding A consisting of the circular wire abcd and with the half-winding B consisting of the circular wire efgh. The half-windings A and B are, in turn, connected at the gap 15 by the wires de and ha to complete the primary turn. As will be appreciated, the current in this primary flows in the direction abcdefgha, as shown by the arrow 100.

The conductor represented by the dashed line a'b'c'd'e'f'g'h'a', on the other hand, constitutes one complete turn of the secondary winding of the transformer 10. This winding consists of the two half-windings C and D—with the half-winding C consisting of the circular wire a'b'c'd' and with the half-winding D consisting of the circular wire e'f'g'h'. The half-windings C and D are connected at the gap 15 by the wires d'e' and h'a' to complete the secondary turn.

With a close juxtaposition of the two windings, a voltage is induced in the secondary winding in response to a current produced in the primary winding. The magnitude of such voltage will be understood to be proportional to the mutual inductance of the two windings. The current flowing as a result of the induced voltage is thus in a direction opposite to that of the current in the primary winding. The current in this winding flows in the direction a'h'g'f'e'd'c'b'a' as shown by the arrow 102.

Figure 1C:
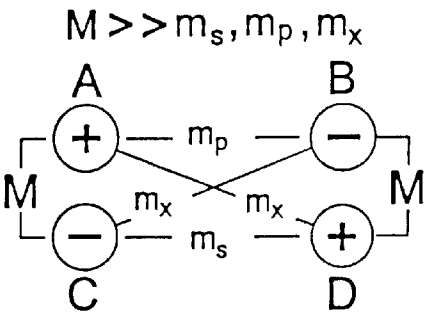

FIG. 1*b* shows the transformer windings in schematic form with the current in the primary winding shown as $I_p$ and with the current in the secondary winding shown as $I_s$. The mutual inductance of the half-windings are illustrated in cross-section in FIG. 1*c*—with $m_p$ and $m_s$ representing the mutual inductance of the primary and secondary windings, respectively. As will be appreciated, the mutual inductance of any two wires depends upon their geometry only, and not upon the currents or voltages in the wires themselves. The closer the wires, the larger the mutual inductance—with the result that the mutual inductance of the coils A and C is greater than the mutual inductance of the coils A and B.

The operation of the articulated transformer according to the invention may be understood in terms of the self- and mutual inductance of the various sections, and with the relationship describing the total inductance of two separate coils connected in series. In particular, where $L_1$ and $L_2$ represent two coils connected in series, the total inductance exhibited is:

$$L=L_1+L_2\pm 2M,$$

where M is the mutual inductance.

The "+" sign obtains when the currents in the coils are series aiding, and the "−" sign obtains when the currents are series opposing. As will be appreciated, the articulated transformer 10 of FIG. 1*a* consists of four half-windings A, B, C and D, connected at the gap 15.

Considering the half-winding A, the current in it forms an almost complete circle except for the short gap 15 between the locations a,d. The magnetic field associated with such current is substantially the same as the field of a completely circular winding—which is similarly true for the half-winding B except that the current in it is in the opposite direction. With the inductance of the primary winding (consisting of A and B in series opposition) being equal to the inductance of A plus the inductance of B, minus twice the mutual inductance $m_p$, the following relationship exists for the primary winding:

$$L_P=L_A+L_B-2m_p$$

Similarly, the inductance of the secondary winding is:

$$L_s=L_C+L_D-2m_s$$

As will be appreciated, the separation between the half-windings A and B, and between the half-windings C and D, is large. At the same time, the mutual inductance is small, and the two windings have substantial total inductance somewhat less than the sum of the first two relationships expressed in the above equations.

In like manner, it will be understood that the current in any half-winding induces a voltage in every other half-winding, with the induced voltage being proportional to the mutual inductance of the two half-windings. Thus a current in winding A induces voltages in winding B, C and D. A current in winding B, likewise, induces a voltage in windings A, C and D. A current in winding C, then induces voltages in windings A, B and D, while a current in winding D induces voltages in windings A, B and C.

The generation of current in half-winding A in the direction shown in FIG. 1*a* induces voltages in the secondary of the transformer in half-winding C and D. In particular, the current in winding A induces a voltage in winding C with the polarities shown in FIG. 1*b* and 1*c*. Similarly, the current in winding B induces a voltage in winding D—with the voltages in winding C and D being series aiding and relatively large because of the large mutual inductance M between winding pairs A,C and B,D. The sum of the voltages induced in winding coils C and D will be appreciated as being the major part of the transformer output voltage.

The voltage induced in winding D by the current in winding A, via the mutual inductance $m_x$, on the other hand, is in a direction to reduce the transformer output voltage, just as is the voltage induced in winding C by the current in winding B. These induced voltages will be seen to be small, however, and because the mutual inductance $m_x$ between the winding pairs A,D and C,B are much smaller than the mutual inductance M of pairs A,C and B,D. As it can be shown that the effective mutual inductance is approximately $2(M-m_x)$, and because $m_x$ is very much less than M, the effective mutual inductance output is only slightly less than twice the output of a conventional transformer consisting of half-windings A and C and without the gap 15 shown in FIG. 1*a*.

With coil winding diameters for A and B of some 2.5 inches, with the coil diameters of windings C and D some 2.0 inches, with nine turns on each winding, with a series resistance of 84 ohms, and with a separation between the half-windings A and B and between the half-windings C and D of some 1.0 inch, for example, an effective mutual inductance was determined to be 6.26 uH. With a conventional transformer consisting only of half-windings A and C, on the other hand, each with nine turns, the mutual inductance was determined to be 4.65 uH, without the gap 15.

Figure 2:
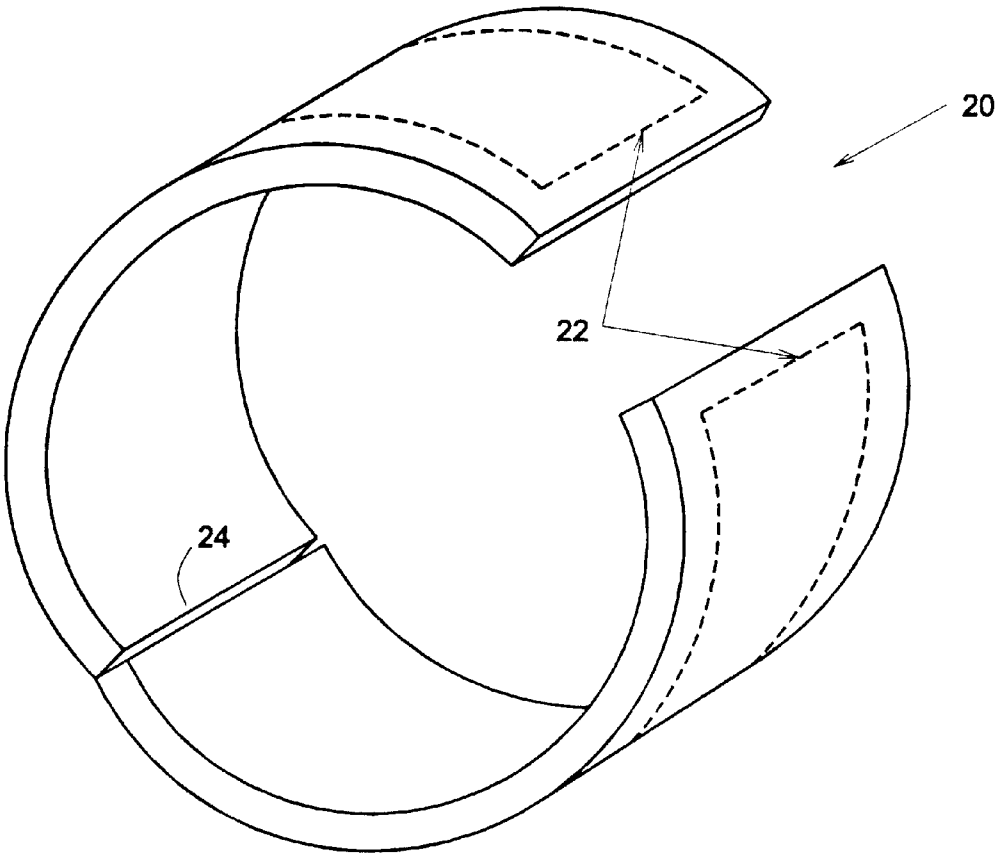
FIG. 2 illustrates how the articulated transformer can be opened at its included gap for placement around a shaft.

FIG. 2 illustrates how the transformer can be opened at the gap for placement around a shaft, and how the mounting cylinder 20 may be opened to place the winding on the shaft without disturbing the winding or its connections. The transformer winding is shown at 22, with the join between the two halves 24 serving to hingeably couple the two halves together.

Figure 3:
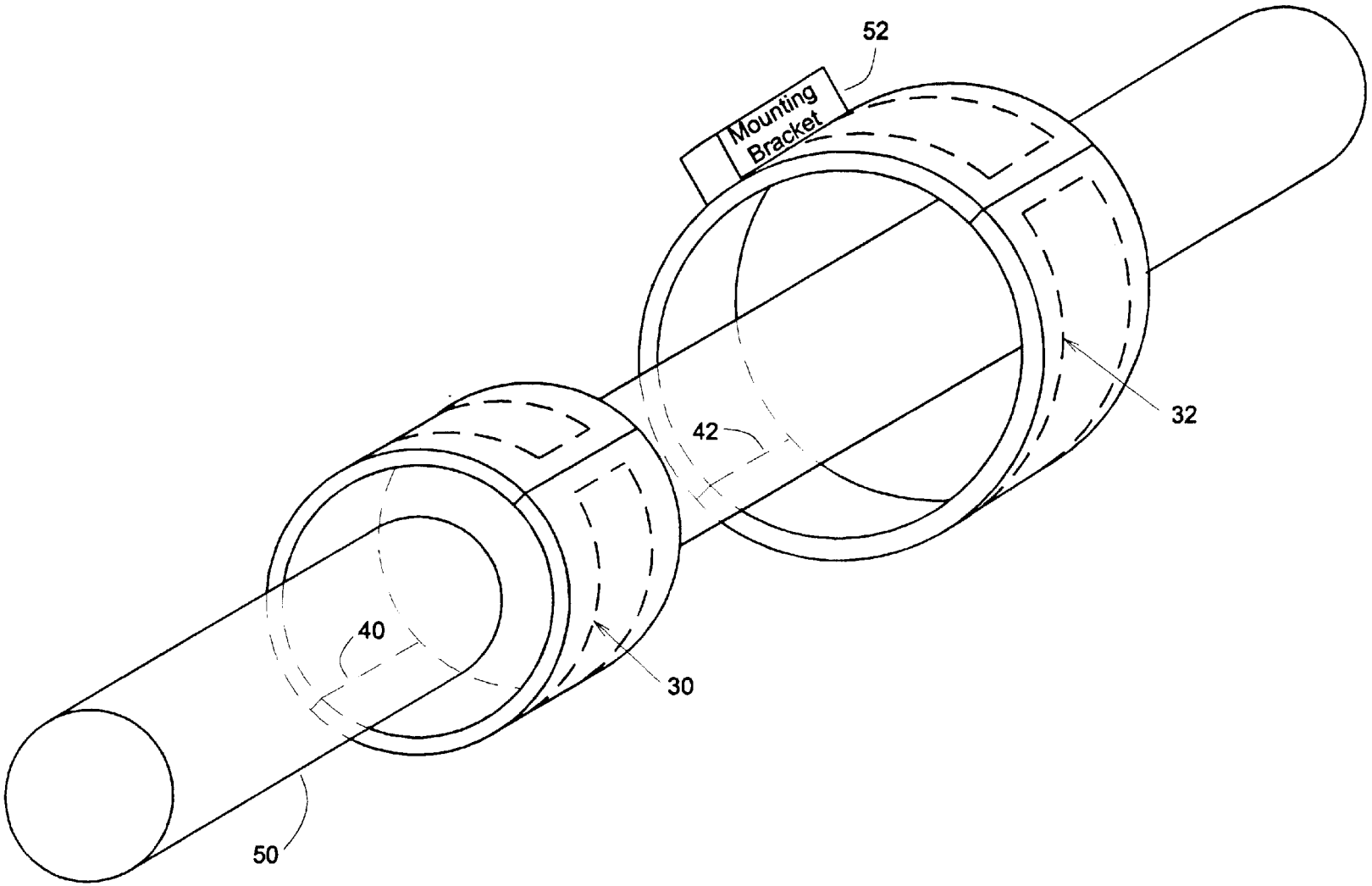
FIG. 3 shows how the primary and secondary winding of the articulated transformer are related to the rotating shaft and to each other, in accordance with its use in measuring torque on the rotating shaft.

The installation of the articulated transformer in conjunction with a drive shaft or axle of an automobile can be appreciated from FIG. 3, in which the rotating winding is shown at 30, and the fixed winding shown at 32. The hinged coupling to allow for the separation in installing the windings are shown at 40 and 42. The rotating winding 30 is fastened to the shaft 50, while the fixed winding 32 is mounted externally by means of a mounting bracket 52. In operation, the windings 30, 32 are coaxial and co-planar, but are not in contact.

Figure 4:
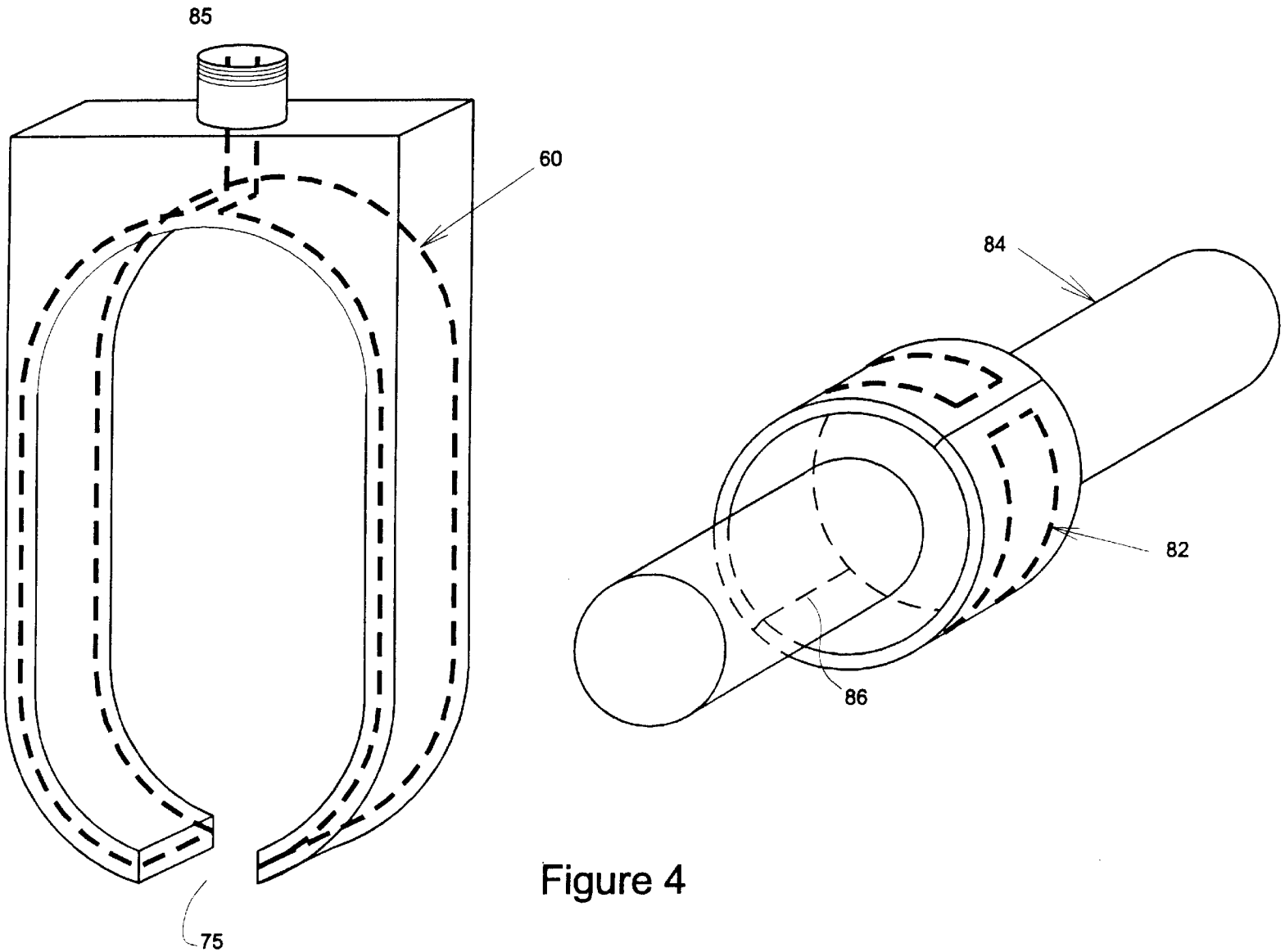
FIG. 4 illustrates a second embodiment of the articulated transformer in accordance with the invention.

FIG. 4 shows a modified embodiment of the invention, in which the primary winding of the transformer 60 is elongated to allow for vertical movement of the shaft containing the secondary winding. This may occur, for example, when the secondary is mounted on the axle of a Front-Wheel-Drive automobile. The primary, then, is mounted on the chassis, and the axle moves vertically as the automobile proceeds over uneven surfaces. The elongated structure shown in FIG. 4 is provided with a gap 75 large enough so that the primary of the transformer can be slipped over the shaft without any hinge being required. Such configuration exhibits less mutual inductance than the arrangement of FIG. 1*a*–1*c*, 2 and 3, but there exists still sufficient mutual inductance for optimum tuned transformer design and operation. In FIG. 4, the secondary transformer winding is shown at 82, the rotating shaft is illustrated at 84, and the hinge to allow the slipping of the secondary transformer winding 82 on the shaft 84 is illustrated at 86. Reference notation 85 identifies a cable connector for the articulated transformer.

As with the configuration of FIGS. 2 and 3, the primary transformer winding mounts on the chassis, and the secondary transformer winding can be fitted onto it just by spreading the two transformer halves about the gap.

While there have been described what are considered to be a preferred embodiments of the present invention, it will be readily appreciated by those skilled in the art that modifications can be made without departing from the scope of the teachings herein. For at least such reason, therefore, resort should be had to the claims appended hereto for a true understanding of the invention.

I claim:

1. In a combination including utilization apparatus; first means including an electrical power oscillator for transmitting electrical power from a first location towards a second location; second means at said second location, responsive to electrical power received from said first means, for operating said utilization apparatus; third means coupled to said utilization apparatus for generating a signal indicative of performance thereat, and for transmitting said signal to said first means via said second means; with said first means being stationary in operation, and with said second means being mechanically rotational in operation; with said second means being devoid of any source of operating power thereon; and with there being an absence of mechanical interconnection between said first means and said second means; wherein said first means also includes a fixed electrical coil; wherein said second means includes an electrical coil on a rotating mechanical shaft; and wherein said fixed electrical coil and said rotating electrical coil are both tuned to form a transformer resonating at the frequency of said oscillator, the improvement comprising: forming said fixed electrical coil and said rotating electrical coil of two half-windings each connected in series, coupled at one end and movable towards and away from an opposite end to removably encompass said rotating shaft.

2. The improvement of claim 1 wherein said first and second coils are spaced from one another by an air gap.

3. The improvement of claim 2 wherein said first and second coils are each mounted co-axially with respect to said rotating shaft.

4. The improvement of claim 3 wherein said first and second coils are mounted co-planar on said rotating shaft.

5. The improvement of claim 4 wherein at least one of said first and second coils is incorporated on a mount openable to place the included winding about the rotating shaft without disturbing the winding or electrical connections thereto.

6. The improvement of claim 5 wherein both of said coils are mounted on cylinders openable to place the winding therein on said rotating mechanical shaft, to insure a voltage to be induced in said second coil in response to a current flowing in said first coil.

* * * * *